United States Patent [19]

Wiley

[11] Patent Number: 4,565,362

[45] Date of Patent: Jan. 21, 1986

[54] TRANSFER APPARATUS

[75] Inventor: Robert T. Wiley, Asheville, N.C.

[73] Assignee: Tex-nology Systems, Inc., Arden, N.C.

[21] Appl. No.: 681,912

[22] Filed: Dec. 14, 1984

[51] Int. Cl.[4] ..... B65H 5/00

[52] U.S. Cl. ..... 271/225; 112/121.29; 271/85; 271/184; 271/268

[58] Field of Search ..... 112/121.29; 271/225, 271/268, 184, 84, 85

[56] References Cited

U.S. PATENT DOCUMENTS

| | | | |
|---|---|---|---|
| 2,964,161 | 12/1960 | Lopez | 198/28 |
| 3,356,237 | 12/1967 | Walton | 214/89 |
| 3,860,231 | 1/1975 | Oltra | 271/85 |
| 3,881,721 | 5/1975 | Hitch | 271/184 |
| 4,066,025 | 1/1978 | Speer | 112/121.29 |
| 4,144,825 | 3/1979 | Welz | 112/121.29 |
| 4,214,541 | 7/1980 | Zeigler, Jr. et al. | 112/262.3 |
| 4,242,956 | 1/1981 | Bubley et al. | 101/123 |

*Primary Examiner*—Richard A. Schacher
*Attorney, Agent, or Firm*—Luedeka & Neely

[57] ABSTRACT

An apparatus is disclosed for transferring a sheet of deformable material such as cloth on a first conveyer to a second conveyer at a right angle to the first conveyor. The apparatus includes a full-length clamp having an elongated support surface for grasping and supporting the sheet along a side edge adjacent to the second conveyor and aligned with the direction of movement of first conveyor. The clamp is supported on a carriage which is movable in the direction of movement of the second conveyer and means are provided to move the carriage between a clamping location where the clamp grasps the sheet and a release location spaced from the first conveyor.

5 Claims, 9 Drawing Figures

TRANSFER APPARATUS

The present invention relates to conveying equipment and more particularly relates to a transfer apparatus for transferring a sheet of deformable material from a first conveyer to a second conveyer which is at a right angle to the first conveyer.

Many apparatus are known for transferring sheets of a rigid material from one conveyer to another conveyer which moves at a 90° angle to the first conveyer. Rigid sheets, even when they are somewhat flexible, may be pushed or pulled from a localized area on the sheet to cause the entire sheet to move. Thus, such sheets are easily moved from one conveyer to the other by means of pushers, grippers, rollers or other devices which apply force to a small area of the sheet which causes the whole sheet to be moved in the desired direction.

For deformable sheets, however, the transfer of a sheet from one conveyer to another conveyer moving at right angles presents problems. Deformable sheets, i.e., sheets which are limp, extensible, or both, such as woven and nonwoven fabrics, scrim, various types of mesh and the like cannot be readily handled by known equipment without producing wrinkles or other distortions in the sheets. For example, in the handling of cloth used in the manufacture of various textile flat goods, many operations such as automated hem formation, folding, etc., require that the cloth be maintained in a flat condition as it is fed to the mechanism for performing the operation. Known equipment is incapable of efficiently transferring cloth so that distortions or wrinkles are not introduced.

It is accordingly an object of the present invention to provide an apparatus for transferring a deformable sheet from a first conveyer to a second conveyer at a right angle to the first conveyer. It is another object of the present invention to transfer a deformable sheet from a first conveyor to a second conveyor at a right angle with a minimum of distortion, wrinkling or alteration the configuration of the sheet.

In accordance with one form of the present invention, the transfer apparatus of the present invention generally includes a clamp for clamping the sheet along a side edge adjacent the second conveyor and in alignment with the direction of movement of the first conveyor. The clamp provides a support surface for supporting the sheet along the side edge and includes an elongated clamping bar movable toward and away from the support surface. The clamp is supported for movement above the second conveyor in a direction parallel to the direction of movement of the second conveyor between a clamping location adjacent the first conveyor and a release location spaced from the first conveyor. The apparatus further includes an elongated, retractable support plate which is operable in a support position to underlie substantially the entire length of the side edge when the sheet is on the first conveyor. The retraction member is movable transversely of the side edge to a retracted position to permit the side edge to overlie the support surface of the clamp when said clamping means is in the clamping position. The clamp engages the sheet in the clamping location between the support surface and the clamping bar and releases the sheet after moving to the release position to transfer the sheet onto the second conveyor.

The transfer apparatus is operable to transfer deformable sheets from a first conveyor to a second conveyor at a right angle while minimizing distortion and wrinkling.

The objects and advantages of the present invention may best be understood by reference to the following detailed description of a preferred embodiment and accompanying drawings in which.

Figure 1:
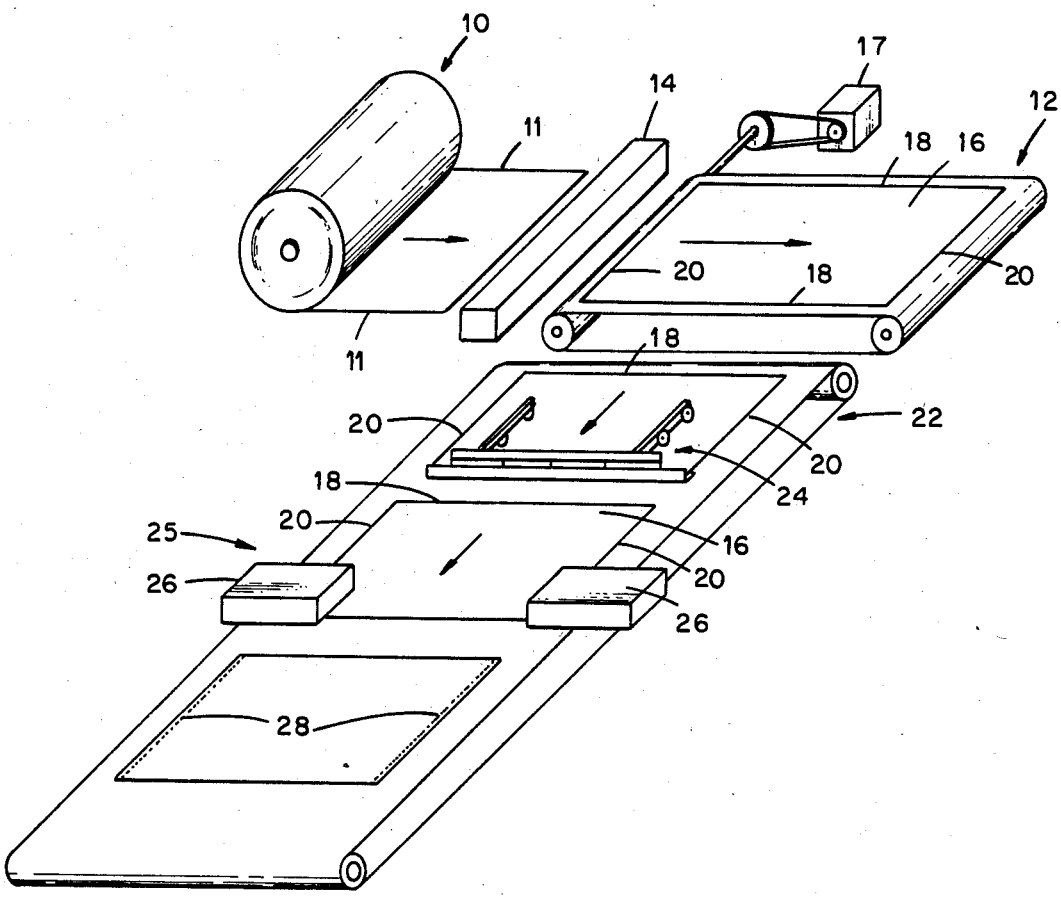
FIG. 1 is a diagrammatical view illustrating equipment and a process for manufacturing bed sheets employing the transfer apparatus of the present invention.

Referring now to the drawings in which like reference characters designate like or corresponding parts throughout the several views, there is shown diagramatically in FIG. 1 equipment and a process for the automated manufacture of bed sheets. The equipment and process is shown for the purposes of illustrating an embodiment of the present invention and there is no intent to limit the invention to the application illustrated.

Referring to FIG. 1, a roll of fabric 10 having a selvage 11 at both side edges is unwound and measured onto a first conveyor 12 where it is cut to a measured length by cutter 14. A sheet of fabric 16 results which is positioned on the first conveyor 12 with the selvage 11 in alignment with the direction of movement of the first conveyor 12. Cut ends 20 are thus perpendicular to the direction of movement of the first conveyor 12.

As shown in FIG. 1, the sheet 16 is then transferred to a continuously running second conveyor 22 having a direction of movement at a right angle to the first conveyor 12. It is necessary for the sheet 16 to be transferred to the second conveyor 22 at a right angle so that the cut ends 20 of the sheet 16 are aligned with the direction of movement of the conveyor 22 so that hem forming operations can be performed as the sheet 16 moves along the second conveyor 22. Indexing mechanism 17 associated with the first conveyor 12 positions the sheet 16 on the first conveyor 12 where the sheet 16 is engaged and transferred to the second conveyor 22 by transfer apparatus 24 of the present invention as will be described in detail hereinafter. Sheets 16 are conveyed on the second conveyor 22 to a hem forming station 25 where hems 28 are formed at both cut end 20 simultaneously by employing hem forming equipment 26 such as is described, for example, in either U.S. Pat. No. 3,850,121 or 4,066,025.

Figure 2:
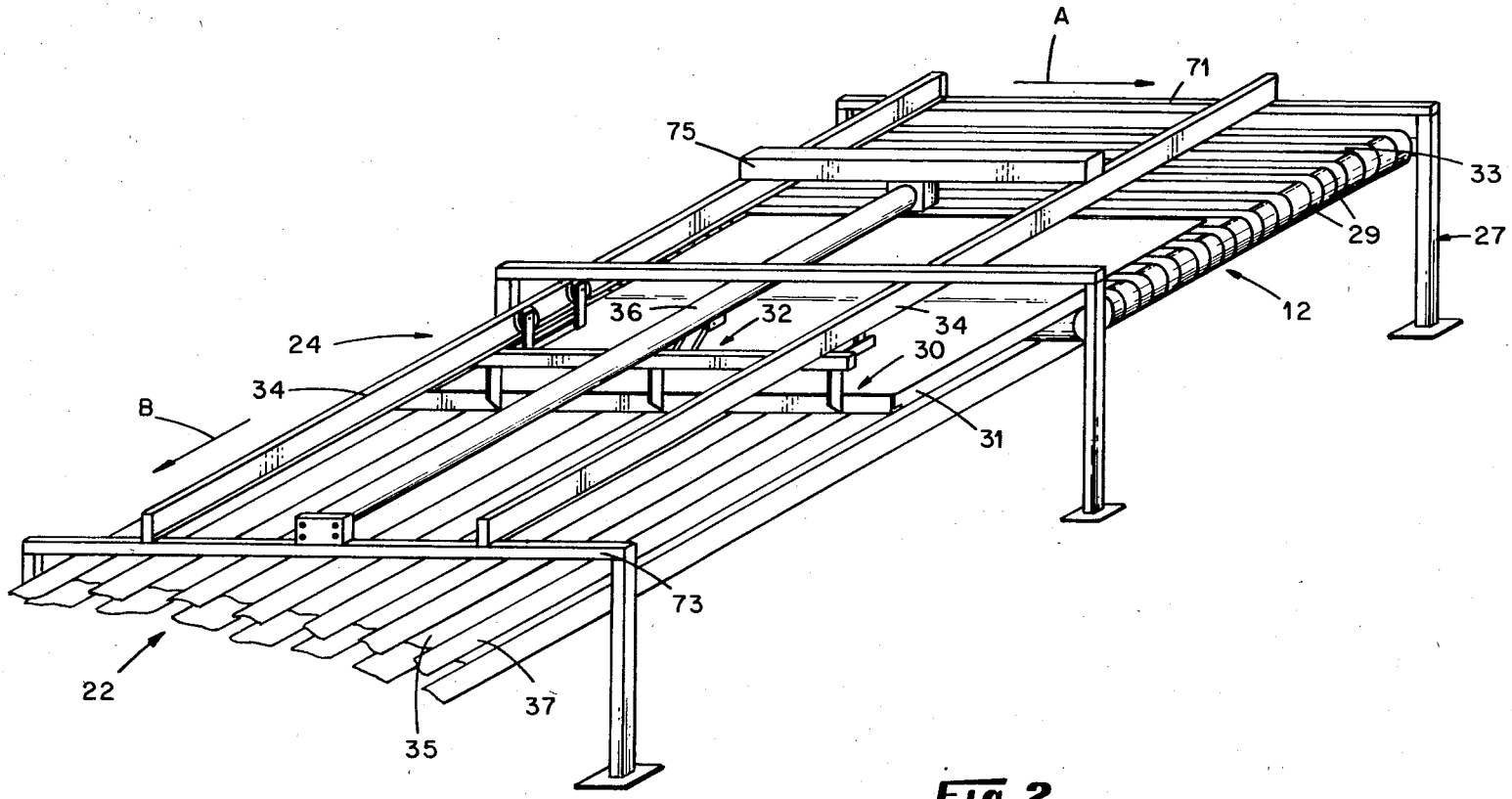
FIG. 2 is a broken-away perspective view of two conveyors at a right angle and a preferred embodiment of one form of the transfer apparatus of the present invention.

Referring now to FIG. 2, there is shown a preferred embodiment of the transfer apparatus 24 of the present invention for transferring sheets of material used for manufacturing bed sheets by the process shown in FIG. 1 from the first conveyor 12 to the continuously running second conveyor 22 which extends to the hem forming station 25 (not shown in FIG. 2). The first conveyor 12 is supported by a frame 27 constructed of suitably interconnected upright and longitudinal members and includes a plurality of spaced-apart endless belts 29 suitably driven and supported on a table 33. The first conveyor 12 is operable to move a sheet 16 in the direction indicated by arrow A. Similarly, the second conveyor 22 is supported on the frame 27 and includes suitably driven spaced-apart endless belts 37 supported on a table 35 for moving a sheet 16 in a direction at a right angle to the first conveyor as indicated by arrow B.

The transfer apparatus 24 generally includes a full-length clamp 30 for clamping onto the sheet 16 on the first conveyor 12 at a side edge 31 which is adjacent the second conveyor 22. The full-length clamp 30 is supported on a carriage 32 which is carried on tracks 34 supported by the frame 27 above a central area of the second conveyor 22. A carriage drive 36 is operable to move the carriage 32 and clamp 30 along the tracks 34 in the direction of movement of the second conveyor 22 between a clamping location adjacent the first conveyor 12 where the clamp 30 is operable to engage the sheet 16 and a release location where the sheeet is deposited on the second conveyor 22. In FIG. 2, a sheet is shown clamped in the clamp 30 and is shown partially transferred with the carriage 32 and clamp 30 advancing toward the release location.

The preferred embodiment of the transfer apparatus 24 depicted is intended for operation with generally horizontal first and second conveyors, 12 and 22, respectively, and with the second conveyor 22 being at a lower vertical level than the first conveyor 12 to facilitate access of the clamp 30 to the side edge 31 of the sheet 16.

Figure 5:
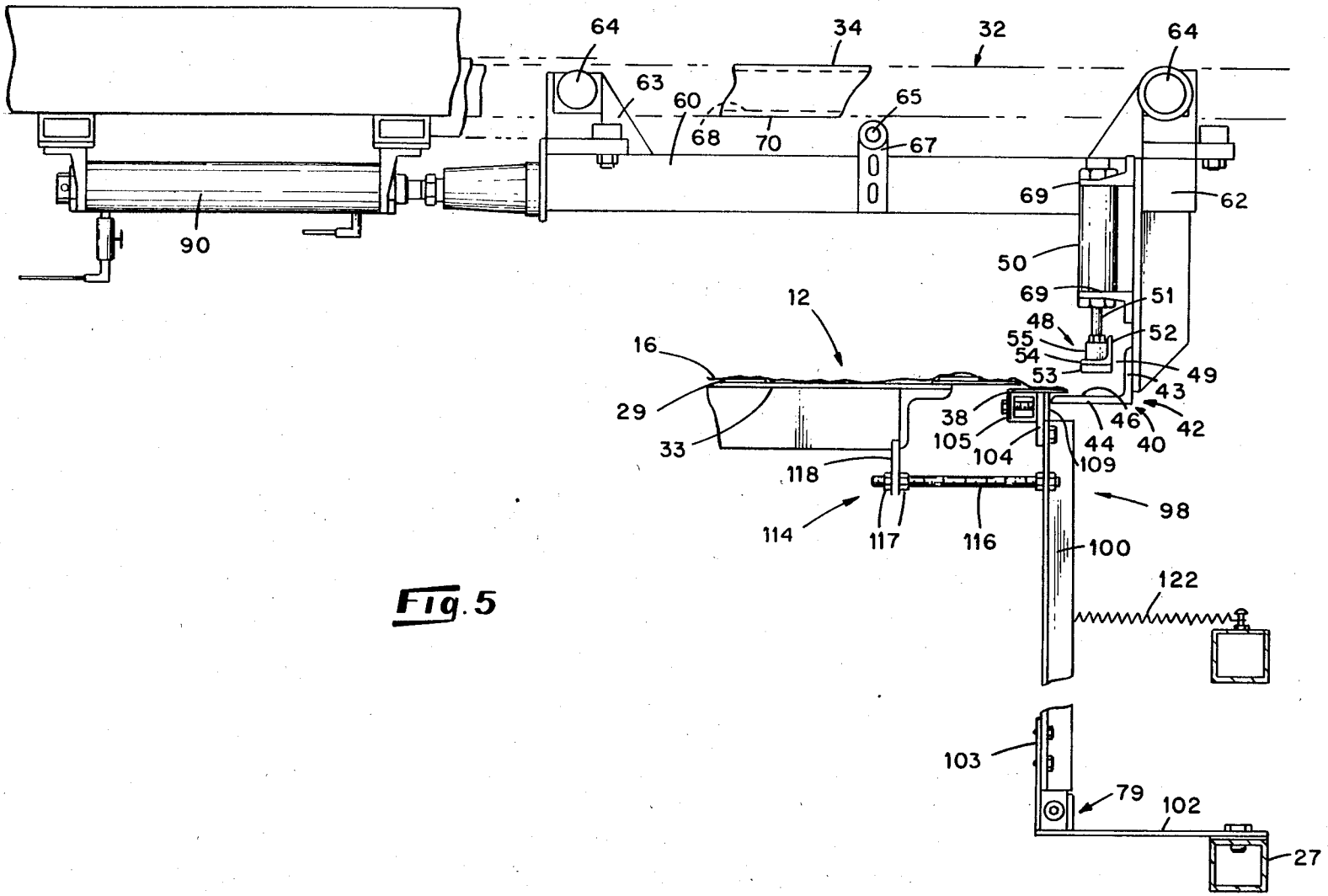
FIG. 5 is an enlarged, broken-away elevational view of the clamp, retractable support plate and carriage of the transfer apparatus shown in FIG. 2.
Figure 6:
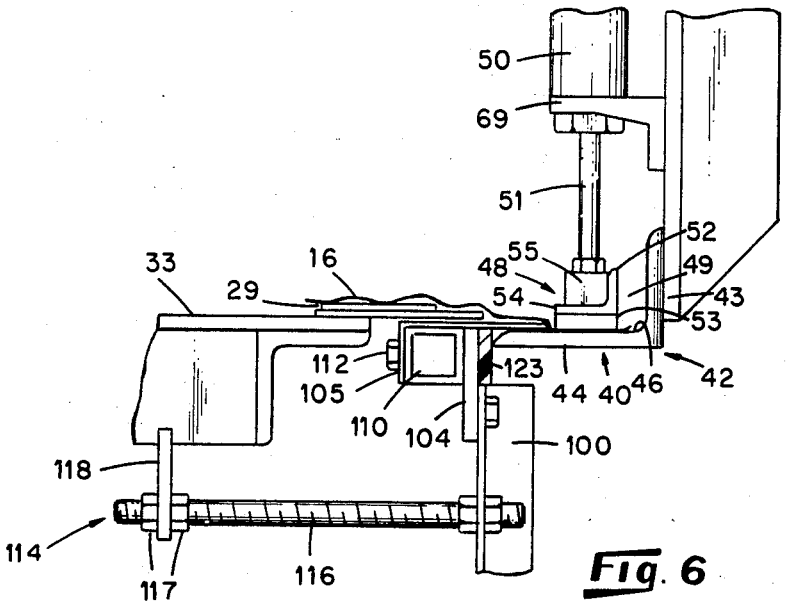
FIG. 6 is an enlarged, broken-away elevational view as in FIG. 5 showing a sheet engaged by the clamp.
Figure 7:
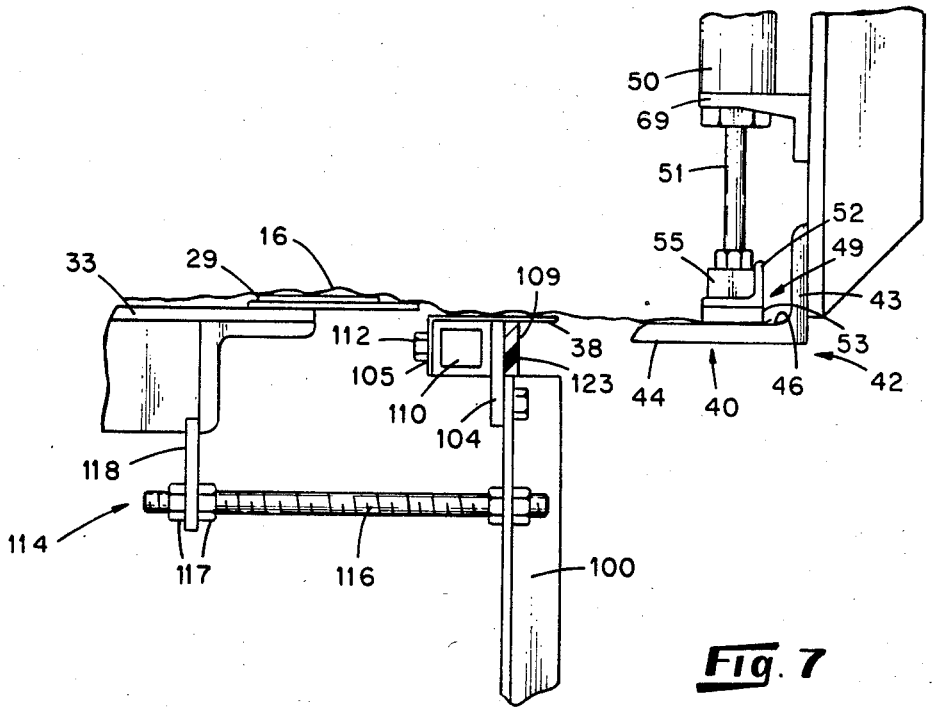
FIG. 7 is an enlarged, broken-away elevational view as in FIG. 6 showing the sheet being moved with the clamp.

As shown in FIGS. 5, 6 and 7, a retractable support plate 38 is operable support the side edge 31 of the sheet when the sheet 16 is on the first conveyor 12 until the edge is clamped by the clamp 30. The clamp 30 includes an elongated clamp plate 40 which extends transversely with respect to the second conveyor 22 and which is supported above the second conveyor on the carriage 32. The clamp plate 40 provides a support surface 46 for supporting the side edge 31 of the sheet 16 along its entire length. The plate 40 is preferably mounted in a generally horizontal orientation at a level approximately that of the first conveyor 12.

In the preferred embodiment, the clamp plate 40 is provided by lower clamp angle 42 which has an upright portion 43 for attachment to the carriage 32 and a horizontal portion 44. The horizontal portion 44 extends from the bottom of the upright portion 43 toward the first conveyor 12 to provide the support surface 46.

An elongated clamping bar 48 is supported above the clamp plate 40 for movement towards the clamp plate 40. Means are provided for moving the clamp bar 48 towards the lower clamp plate 40 to clamp the sheet between the clamp bar 48 and the clamp plate 40. In the preferred embodiment, a suitable number of air cylinders 50 mounted on the carriage support the upper clamp bar 48 and are operable to urge it towards the lower clamp plate 40 to clamp the sheet 16.

In the preferred embodiment depicted, the upper clamp bar 48 is preferably an angle member 49 which is which has a length equal to the length of the support surface 46 and which is connected to rods 51 of the air cylinders 50. An upright portion 52 of the angle 49 is connected to cylinder attachment block 55 with suitable fasteners and rods 51 on the cylinders 50 are threaded and are received into threaded bores in the blocks 55. A horizontal portion 54 of the angle 49 extends towards the first conveyor 12. As shown, the underside of the horizontal portion 54 of the angle 49 is preferably provided with a resilient strip 53 such as a strip of rubber or the like in order to provide a resilient upper engagement surface for more effectively clamping the sheet 16.

Figure 3:
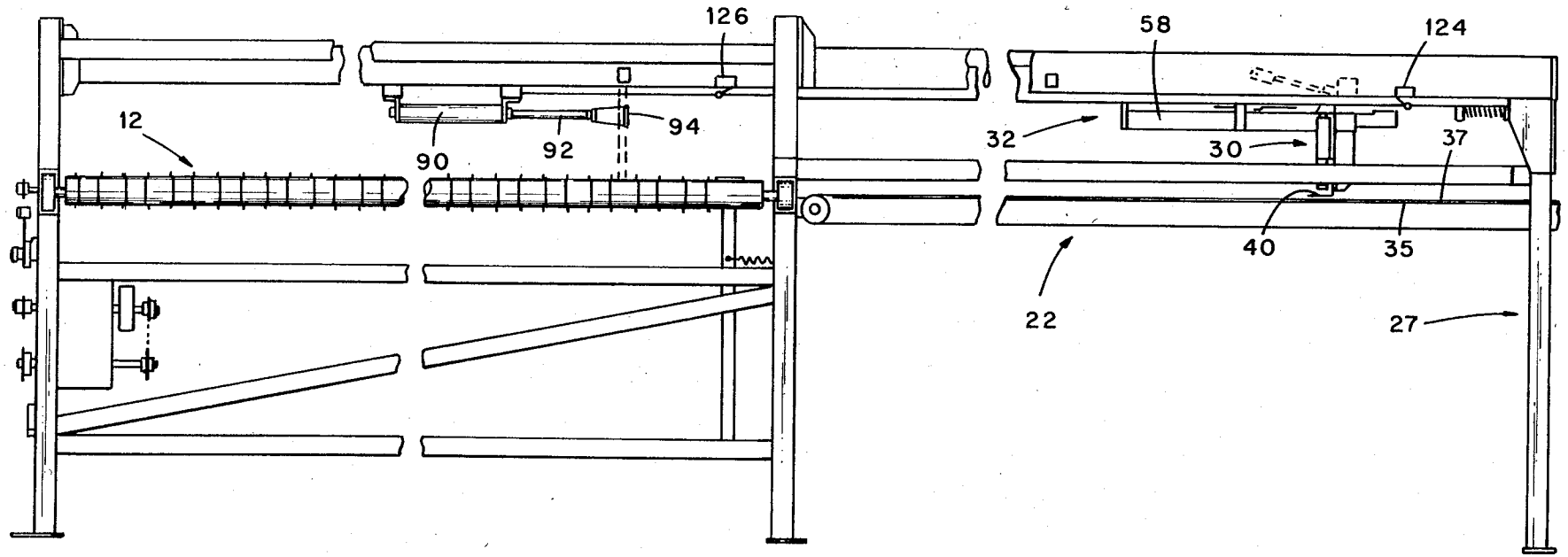
FIG. 3 is an elevational view of the transfer apparatus shown in FIG. 2.
Figure 4:
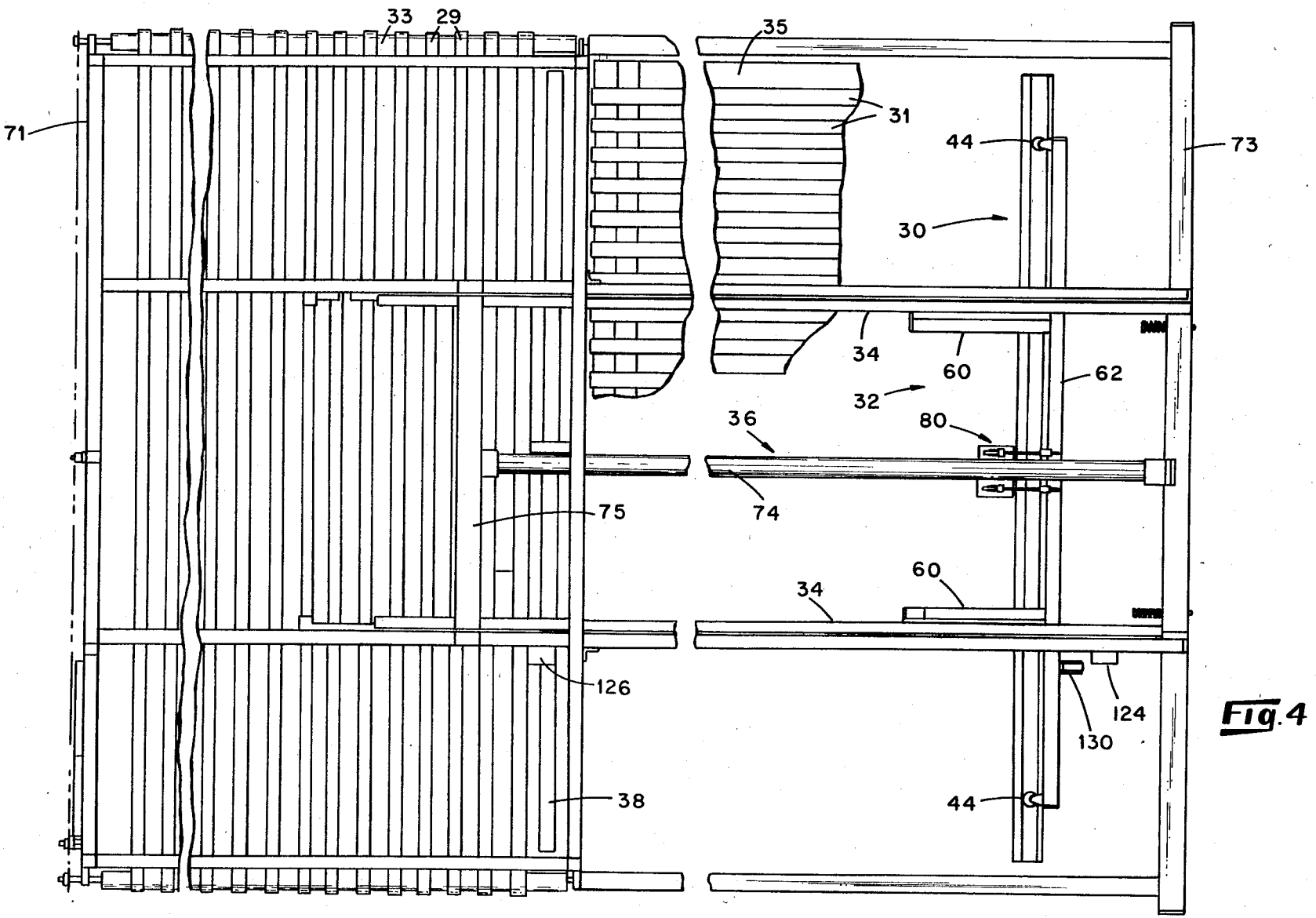
FIG. 4 is a top plan view of the transfer apparatus shown in FIG. 2.

The carriage 32 for supporting the clamp 30 is shown most clearly in FIGS. 3, 4 and 5. The carriage includes a rigid frame 58 supported on wheels 64 which ride on the tracks 34. In the preferred embodiment, the frame 58 is constructed of two longitudinal beams 60 and a crosspiece 62 which connects the two longitudinal beams 60 at a position remote from the first conveyor 12. The wheels 64 are mounted in an overhead position on the frame by brackets 63 attached to the longitudinal members which elevate the wheels 64 above the frame 58 with two wheels on each side of the frame 58. The carriage 32 is preferably held on the tracks by two hold-down wheels 65, mounted on brackets 67 intermediate and below wheels 64 on each side of the frame 58. Hold-down wheels 65 contact the underside of the track 34 in order to hold the carriage 32 on the track 34 as it rolls. As shown in FIG. 5, the tracks 34 provide a rolling surface 68 for the wheels 64 on the carriage 32 and additionally provide a hold down surface 70 for contacting the hold-down wheels 65. The tracks are suitably provided by inwardly-facing structural channels with the lower inwardly extending strip of the channel providing the rolling surface 68 and the underside surface of the same strip providing the hold down surface 70. Alternately, other structural members such as I-beams or angle irons may be similarly used to provide the tracks 34.

The tracks 34 are supported by suitable transverse and upright members which preferably are attached to the conveyor frame 27. In the preferred embodiment, end transverse members 71 and 73 are supported by the conveyor frame uprights to support the ends of the track 34 and an intermediate transverse member 75 connects between the tracks 34 at an intermediate location.

In the preferred embodiment, the clamp 30 is connected to the frame 58 of the carriage 32 at the crosspiece 62. The crosspiece 62 extends outwardly from the longitudinal beams 60 on both sides of the frame 58 and upright clamp supports 66 extend downwardly from the crosspiece 62 at the spaced-apart locations to the upright portion 43 of the lower clamp angle 42. As illustrated, five upright clamp supports 66 are employed in the preferred embodiment and five air cylinders 50 are attached by upper and lower clamp cylinder brackets 69 to the upright clamp supports 66.

As shown in FIG. 4, the tracks 34 are shown to extend over the first conveyor 12 so that a portion of the carriage 32 extends over the first conveyor 12 when the clamp 30 is in the clamping position adjacent the first conveyor 12. The tracks 34 are parallel and are spaced-apart above a central area of the second conveyor and extend in the direction of movement of the second conveyor to a position from the first conveyor 12 so that the carriage 32 and clamp 30 travel sufficiently far to carry the sheet onto the second conveyor 22.

Referring now to FIGS. 2, 4, 8 and 9, the carriage drive 36 is shown. The carriage drive 36 is operable to move the carriage 32 carrying the clamp 30 to the clamping location adjacent the first conveyor 12 and a spaced release location such as the position shown in FIG. 4. For the embodiment described with the continuously running second conveyor 22, it is necessary for the carriage drive to move the carriage faster than the speed of the second conveyor when the clamp 30 and carriage are traveling to the release position.

The carriage drive 36 is preferably provided by an elongated double-acting air cylinder 72 extending parallel to and between the tracks 34 to move the carriage in both directions along the tracks 34. A suitable cylinder is a cylinder sold under the trademark ORIGA, Number PY 1202-122 with a 63 mm diameter and a 120 inch stroke manufactured by Origa of Elmhurst, Ill. The air cylinder is preferably centered between the tracks 34 and is supported at each end by end transverse member 73 and intermediate transverse member 75. Preferably, as shown most clearly in FIGS. 8 and 9, the end of the double-acting air cylinder 72 remote from the first conveyor is supported by a bracket 74 above end transverse frame member 73 and is hung from intermediate transverse member 75 at the end adjacent the first conveyor 12 by cylinder hanger bracket 76.

Figure 8:
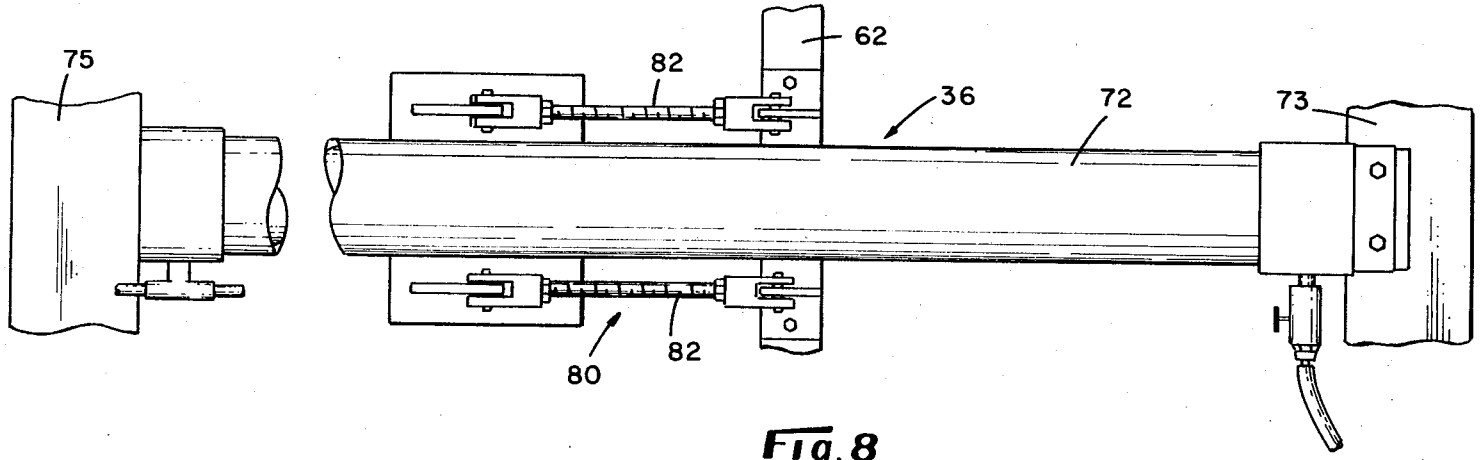
FIG. 8 is an enlarged, broken-away top view of a portion of a carriage drive mechanism which is part of the transfer apparatus of FIG. 2.
Figure 9:
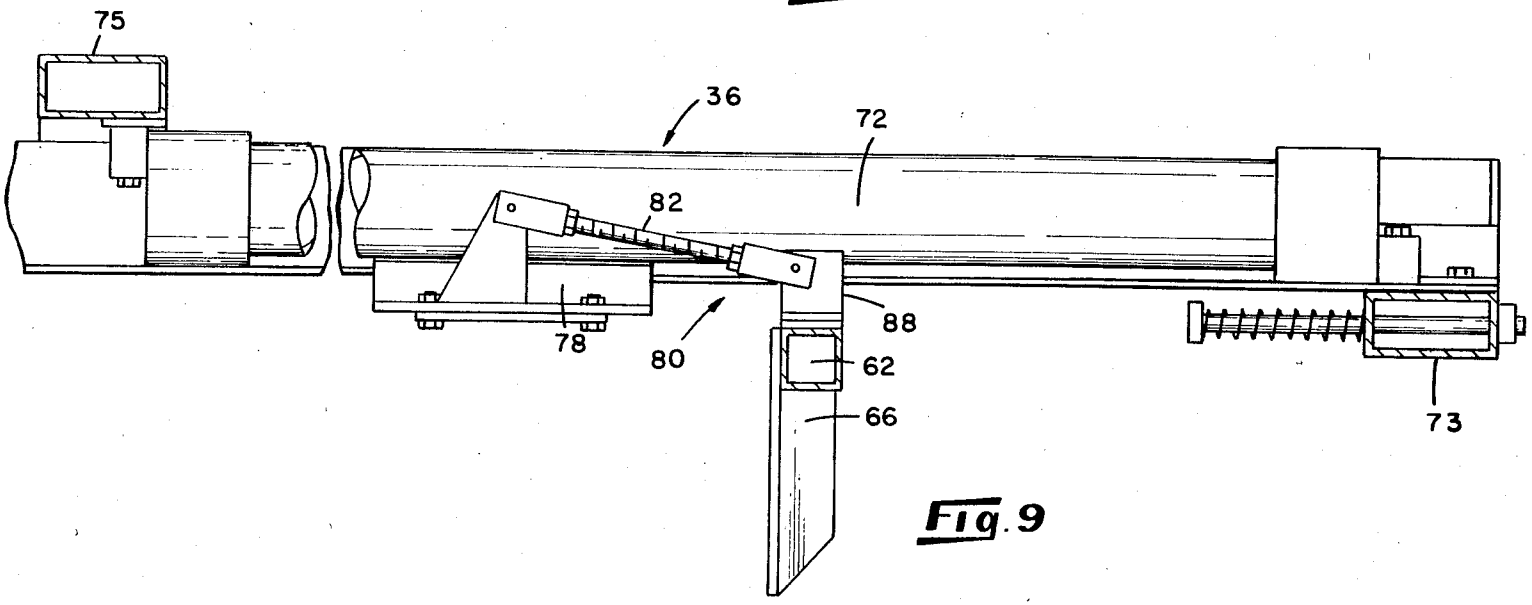
FIG. 9 is an enlarged broken away side view of the carriage drive shown in FIG. 8.

As shown in FIGS. 8 and 9, the air cylinder 72 has a connecting lug 78 which extends out of a slit extending along the entire length of the underside of the air cylinder 72. The lug 78 is connected to a piston (not shown) which is enclosed in the cylinder 72 and acts to move the connecting lug 78 along the length of the cylinder 72.

The carriage 32 is connected to the connecting lug 78 by carriage connecting means 80 which transmits movement of the lug 78 to the carriage 32. As shown in FIGS. 8 and 9, the carriage connecting means 80 preferably includes two connecting rods 82 which extend between the connecting lug 78 and the carriage 32.

As is shown in FIGS. 3 and 5, the preferred embodiment of the present invention also includes booster cylinders 90 which are attached to each of the tracks 34 above the first conveyor 12. The booster cylinders 90 have rods 92 and engagement feet 94 which are operable to engage the frame 58 of the carriage when the clamp 30 approaches and is in the clamping position. The booster cylinders 90 are appropriately controlled to achieve a high initial acceleration of the carriage 32 and clamp 30 as they begin to move the sheet and, in addition, to provide a cushion for the carriage 32 to slow it down as it returns to the clamping position.

Referring now to FIGS. 5, 6 and 7, the retractable support plate 38 is shown extending along the edge of the first conveyor 12 adjacent the second conveyor 22. The retractable support plate 38 provides an elongated horizontal upper surface which is parallel to the first conveyor 12. The retractable support plate 38 is supported for motion toward and away from the first conveyor 12 between a support position as shown in FIG. 5 for supporting a strip of the sheet 16 at the side edge 31 on the first conveyor and a retracted position as shown in FIG. 6. Preferably, the support plate 38 supports the sheet 16 in the support position with the side edge 31 parallel to and closely adjacent to the edge of the support plate. It is necessary, however, that the sheet 16 does not extend over the edge of the plate 38 (see FIG. 5).

Referring to FIG. 5, the retractable support plate 38 is supported from below by a swing mechanism 98. The swing mechanism 98 includes a pivot arm 100 which has a sufficient length such that the retractable support plate 38 does not substantially change from its horizontal orientation as the retractable support plate moves on the pivot arm 100. Preferably, two or more pivot arms 100 are employed to support the retraction plate 96 at spaced-apart locations.

As shown in FIGS. 5, 6 and 7 a suitable construction for pivot arm 100 employs a pivot point 99 provided by a stationary support member 102 attached, for example, to the frame 27. The pivot arm 100 is suitably fabricated from angle iron and a pivot bracket 103 is employed to pivotally attach the lower end of the pivot arm 100 to the support member 102. The upper ends of the several pivot arms 100 are connected together by a connecting member such as to a bar 104. The bar 104 extends between the arms 100 beneath the retractable support plate 38 and provides a vertical contact face 109 toward the second conveyor 22 directly below the retractable support plate 38.

Preferably, the retractable support plate 38 is attached to the arms 100 and bar 104 by a downwardly extending portion 105. A spacer bar 110 provided by a box beam, for example, is positioned between the downwardly extending portion 105 and fasteners such as bolts 112 secure the downwardly extending portion 105, spacer bar 110 and bar 104 together and to the arms 100. The contact face 109 is recessed beneath and directly below the support plate 38 and is preferably covered by a resilient strip 123.

As shown in FIGS. 5, 6 and 7, the table 33 includes a table extension plate 111 for supporting the side edge 31 of the fabric and for providing a clearance space for receiving the retractable support plate 38. As shown in FIG. 5, a belt 29 of the first conveyor 12 rides on the table extension plate 111 to carry the sheet 16 adjacent to the side edge 31 so that the side edge 31 is effectively carried along the retractable support plate 38 as the sheet moves on the first conveyor 12.

Referring still to FIGS. 5, 6 and 7, the swing mechanism 98 is shown to include a stop mechanism 114 which stops the travel of the retractable support plate toward the second conveyor 22 at the support position. The stop mechanism 114 includes a stop member 118 connected to the swing mechanism 98 which contacts a stationary member such as a table support member 119 under the first conveyor table 33. A suitable construction is shown in FIGS. 5, 6 and 7, which includes a threaded rod 116 attached to the pivot arm 100 and the stop member 118 which is attached to the threaded rod 116 by nuts 117 as is shown. The nuts 117 permit adjustment of the support position for the retractable support member 38.

As shown in FIG. 5, the retractable support member 38 is resiliently urged toward the support position by spring 122 which is attached to a transverse member of the conveyor frame 27.

The swing mechanism 98 is operable in response to the movements of the clamp 30 on the carriage 32 to support the retractable support plate for movement to the retracted position when the clamp 30 moves into the clamping location. As shown in FIGS. 5, 6 and 7, the lower clamp plate 40 of the clamp 30 is supported at an appropriate height by the carriage 32 to fit under the retractable support plate 38 and to contact the vertical contact face 109 beneath the support plate 38. Retraction of the plate 38 from the support position of FIG. 5 to the retracted position of FIG. 6 is thus accomplished by the clamp plate 40 contacting the vertical contact face 109 and moving the plate 38 as the clamp 30 moves into the clamping position.

The operation of the clamp 30 and the movement of the carriage 32 on the tracks 34 is operated and controlled by appropriate compressed air connections, valves and control circuitry. As shown for the preferred embodiment in FIGS. 3 and 4, a release limit switch 124 is provided at an appropriate position along the tracks 34 at a position remote from the first conveyor 12. The release limit switch 124 is operable to be engaged by the frame 58 of the carriage 32 when a sheet 16 has been carried onto the second conveyor 22. The release limit switch 124 activates control circuitry which causes the cylinders 50 of the clamp 30 to release the sheet and continues operation of the carriage drive 36 to continue the movement of the carriage 32 to move the clamp 30 clear of the sheet 16 and then reverses the direction of the carriage drive 36 so that the clamp 30 is moved towards the clamping position adjacent to the first conveyor 12. Along the tracks 34 above the first conveyor 12 is a clamping position limit switch 126 which is operable through the control circuitry to actuate the air cylinders 50 of the clamp 30 to engage the sheet 16 and to actuate the carriage drive 36 to begin the carriage 32 moving back towards the release position. In addition, the clamping position limit switch 126 actuates the booster cylinders 90 which aid in initiating motion of the carriage 32. An electric eye 130 mounted on the carriage 32 is employed to detect the trailing edge of a previously transferred sheet and operates similarly to limit switch 124. The electric eye 30 activates control circuitry which cause the clamp 30 to release the sheet, to continue the movement of the clamp 50 to clear the sheet 16, and to reverse the direction of the carriage 32.

In operation, a sheet 16 is properly positioned on the first conveyor by the indexing mechanism 17 with the side edge 31 adjacent the second conveyor 22 and with the retractable support plate 38 underlying the side edge 31. The clamp 30 is carried by the carriage 32 and the clamp plate 40 of the clamp 30 contacts the vertical contact face 109 beneath the retractable support plate 38. FIG. 5 shows the retractable support plate 38 in the support position with the clamp plate 40 in contact with vertical contact face 109. Referring now to FIG. 6, as the clamp 30 and carriage 32 are moved towards the clamping position by the carriage drive 36, the retractable support plate 38 is moved to the retracted position under the table extension 111 at the edge of the first conveyor 12 and the strip of the sheet 16 along the side edge 31 is transferred from the retractable support plate 38 onto the sheet support surface 46 provided by the clamp plate 40. At this time, the clamping position limit switch 126 actuates the clamp 30 which causes air cylinders 44 to move the clamp bar 48 towards the clamp plate 40 and the sheet 16 is clamped between the sheet support surface 46 and the resilient strip 53 of the clamp bar 48. In addition, the limit switch 126 activates the carriage drive 36 and the booster cylinders 90 which begin the movement of the carriage 32 and clamp 30 towards the release position as is shown in progress in FIG. 7.

The sheet is pulled by the clamp and carriage onto the second conveyor 22 until the electric eye 130 sees a trailing edge of a previously transferred sheet or until the frame 58 of the carriage 32 contacts the release limit switch 124. In either event, the clamp 30 releases the sheet 16 by moving the clamp bar 48 upwardly as the clamp 30 continues to move along with the carriage to clear the sheet 16. The control circuitry then reverses the carriage drive 36 and moves the clamp 30 and carriage 32 back towards the clamping position. In the meantime, operations on the first conveyor are performed with the equipment and process shown in FIG. 1. The cutter 14 is employed to cut another sheet 16 and the indexing mechanism 17 positions the new sheet 16 on the first conveyor with the retractable support plate 38 underlying the side edge 31 of the sheet 16. The clamp 30 again moves into the clamping position and the operation as has been described is repeated.

The present invention provides a transfer apparatus for sheets of deformable material regardless of the weight or body of the material being clamped. The transfer apparatus operates effectively and minimizes the introduction of wrinkles or other distortions into the sheet. An important advantage of the present invention is that operations on the first conveyor such as the cutting operation can be continued as soon as a previous sheet is clear of the first conveyor. A sheet can thus be moved onto the first conveyor 12 with the retractable support plate underlying the side edge 31 as the clamp 30 is returning to the clamping position. The speed and efficiency of the overall process is thus greatly increased. In addition, as with the embodiment of the invention as described herein, the transfer apparatus can be employed with a continuously running second conveyor to further increase speed and efficiency.

Although a preferred embodiment of the present invention has been described in the foregoing detailed description, it would be understood that the invention is capable for numerous modifications without departing from the spirit of the invention as set forth in the appended claims.

What is claimed:

1. An apparatus for transferring a sheet of deformable material on a first conveyor to a second conveyor having a direction of movement at right angles to the first conveyor, said sheet having a side edge adjacent said second conveyor aligned with the direction of movement of said first conveyor, said apparatus comprising:

means for clamping said sheet along said side edge, said clamping means having an elongated support surface for supporting said sheet along substantially the entire length of said side edge and an elongated clamping bar which is movable toward and away from said support surface;

means for supporting said clamping means for movement above said second conveyor in a direction parallel to the direction of movement of said second conveyor between a clamping location adjacent said first conveyor and a release location spaced apart from said first conveyor;

an elongated, retractable support plate movable between a support position and a retracted position, said plate being positioned in said support position to underlie substantially the entire length of said side edge when said sheet is on said first conveyor, said support plate being movable transversely of said side edge from said support position to said retracted position where said side edge extends beyond said retractable support plate to permit said side edge to overlie said support surface of said clamping means when said clamping means is in said clamping location; and said clamping means being operable to clamp said side edge between said clamping bar and said support surface of said clamping means when in the clamping location, and to release said sheet when said clamping means is in said release location, whereby said sheet is carried by said clamping means as said clamping means moves from said clamping location to said release location and is deposited on said second conveyor.

2. The apparatus of claim 1, wherein said retractable support plate is yieldably supported in said support position and is moved to said retracted position in response to the movement of said clamping means as said clamping means approaches said clamping location so that said side edge on said plate is transferred onto said support surface as clamping means moves into said clamping location.

3. The apparatus of claim 1 wherein said support surface of said clamping means is at a level below the upper surface of said retractable support plate when said clamping means is in the clamping location.

4. The apparatus of claim 3 wherein at least a portion of said support surface of said clamping means is beneath said retractable support plate when said clamping means in the clamping location.

5. The apparatus of claim 1 wherein said clamping bar has a length approximately equal to the length of said support surface and has a resilient, downwardly facing contact surface opposing said support surface.

* * * * *